US006922008B2

(12) United States Patent
Zhao

(10) Patent No.: US 6,922,008 B2
(45) Date of Patent: Jul. 26, 2005

(54) LAMP BULB WITH OPTICAL PATTERN

(76) Inventor: Guoliang Zhao, c/o Tianhao electronics manufactory, Xitailong Industrial District, Shatian Town, Dongguan City, Guangdong Province 523 992 (CN)

( * ) Notice: Subject to any disclaimer, the term of this patent is extended or adjusted under 35 U.S.C. 154(b) by 117 days.

(21) Appl. No.: 10/421,867

(22) Filed: Apr. 24, 2003

(65) Prior Publication Data

US 2004/0145293 A1 Jul. 29, 2004

(30) Foreign Application Priority Data

Jan. 28, 2003 (CN) ..... 03113699 A

(51) Int. Cl.[7] ..... H01K 1/28; H01K 1/30
(52) U.S. Cl. ..... 313/317; 313/578; 313/573
(58) Field of Search ..... 313/315, 317, 313/578, 493, 477 R, 573, 634, 110, 9; 362/255–256, 351, 317, 267, 235, 237

(56) References Cited

U.S. PATENT DOCUMENTS 4,324,066 A * 4/1982 Smith et al. ..... 446/219
5,508,587 A * 4/1996 Williams et al. ..... 313/578
5,793,159 A * 8/1998 West et al. ..... 313/580
6,218,785 B1 * 4/2001 Incerti ..... 315/185 S

FOREIGN PATENT DOCUMENTS

JP 59128727 A * 7/1984 ..... H01J/9/00
JP 2003272525 A * 9/2003 ..... H01J/9/24

* cited by examiner

*Primary Examiner*—Karabi Guharay
(74) *Attorney, Agent, or Firm*—Michael Bednarek; Pillsbury Winthrop Shaw Pittman LLP

(57) ABSTRACT

This invention is related to a lamp bulb with optical pattern, which consists of a bulb body, a filament and a conducting wire. The filament in the bulb body was conducted out from the tail of the bulb body by the conducting wire. The head of the bulb body is a solid, the outside is a convey arc and the inside is a triangle. The filament is connected to the conducting wire in a straight line. The bulb of the present invention has a higher luminosity and can use fully the light emitted from the filament. Because of the special structure in the bulb body, the light beam emitted by the bulb forms beautiful patterns. For example, it can form directly eye-shaped or solar eclipse-like aureola halo patterns.

4 Claims, 2 Drawing Sheets

LAMP BULB WITH OPTICAL PATTERN

TECHNICAL FIELD

The present invention relates to a lamp bulb with optical pattern.

BACKGROUND ART

Presently those mini-bulbs or small bulbs of the prior art may not be able to converge the light emitting therefrom because the head portions thereof are in the cone or column shapes. Consequently, not only their luminosity is lowered and the light emitted from the filament is not sufficiently utilized, but also the patterns formed by the rays emitted from the bulb are simple and create no aesthetic feelings. Furthermore, it cannot form an eye-shaped halo pattern.

DISCLOSURE OF INVENTION

The objective of the present invention is to provide a lamp bulb with optical pattern, which can shine more brightly with the same power and shine directly out some halo patterns.

The above objective of the present invention can be achieved by a lamp bulb with optical pattern consisting of a bulb body, a filament and a conducting wire, wherein the filament in the bulb body is conducted by the conducting wires out through the rear portion of the bulb, and the inner shape of the head of the bulb body is in a solid triangular shape, and while the outer shape thereof is of a convex arc, and the filament is connected to the conducting wire in a straight line, and the tail of the bulb body is oblate.

The objective of the present invention can also be achieved in such a way that hot air is blown from the other end (i.e. rear portion) of the bulb body (1) into the head portion in fixed amounts to make the head of the bulb body (1) to be a solid glass body with the outside being a convex arc and the inside a triangle, when the head of the bulb body (1) is being rotated and sintered. A filament(2) is connected rigidly to a conducting wire(3) at a right angle, i.e. the filament(2) forms a straight line.

To avoid the relative movement between the bulb and the holder, the tail of the bulb body is made oblate.

With this structure, since the head of the bulb body has been formed as a solid glass body with the outside being a convex arc and the inside a triangle, the difference in the thickness of the glass solid body makes the light emitted from the filament present different converging effect and the light beam form an eye-shaped halo pattern, resulting in improved light and vision effects. Because of the oblate rear portion of the bulb, the relative movement between the bulb and the holder cannot occur.

PREFERRED EMBODIMENT

Figures 1A, 1B, 1C:
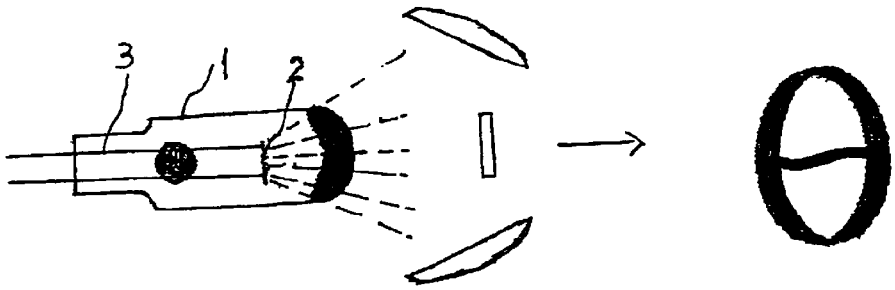
FIG. 1A shows the schematic diagram of the structure of the present invention.
FIG. 1B shows schematically the mechanism of the present invention.
FIG. 1C shows schematically the effect of the present invention.

The lamp bulb with optical pattern of the present invention as showed in FIG. 1 consists of a bulb body (1), a filament (2) and a conducting wire (3). The filament (2) in the bulb body (1) is conducted by the conducting wire (3) out from the rear portion of the bulb. The head of the bulb body is a solid, the outside is in a shape of convex arc and the inside is of a triangle. The filament (2) is connected to the conducting wire (3) in a straight line. The rear portion of the bulb body (1) is oblate. FIG. 1B shows schematically the mechanism of the present invention. When the bulb is used, the light from the filament (2) emits through the head of the bulb body, forming an eye-shaped halo pattern as shown by FIG. 1C, and producing different converging effects and improved light and vision results. The oblate rear portion of the bulb body solidly connects the bulb to the holder.

Figure 2:
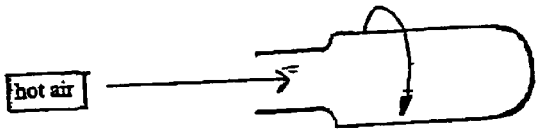
FIG. 2 shows the process to achieve the present invention.
Figure 3:
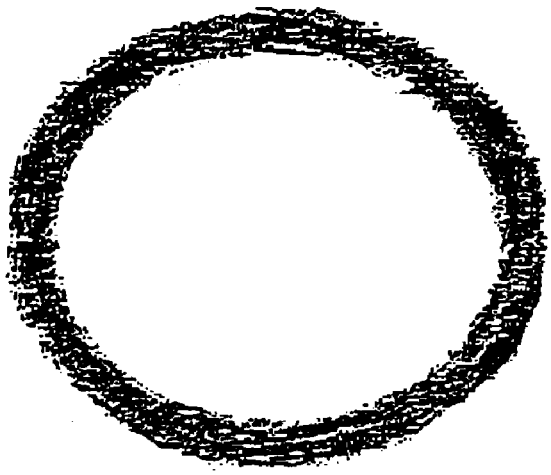
FIG. 3 shows the solar eclipse-like aureola shined out by the lamp bulb with optical pattern.

As showed in FIG. 2, when the head of the bulb body (1) is being rotated and sintered, hot air is blown in fixed amounts from the rear portion of the bulb body (1) into the head to make the head of the bulb body (1) form a solid glass body, with the outside being a shape of convex arc and the inside a triangle. A filament (2) is connected rigidly to a conducting wire (3) at a right angle, i.e. the filament (2) forms a straight line.

The bulb according to the present invention has higher luminosity and the light emitted by the filament can be sufficiently utilized. Because of the special structure in the bulb body, the bulb's light beam forms beautiful patterns, such as eye-shaped halo pattern. The invention opened the market of Christmas bulb and bulb string and changed the simple condition of Christmas bulb. The bulb of the present invention, with the beam and halo background patterns, can provide better light and vision effects. The hanging articles and decorative articles'beam and halo background patterns also have special vision effects. With the luminaries' beam and halo background patterns, the bulb of the present invention can be widely used in the light design fields of homes, stages, theatres background pictures, advertisements, etc.

What is claimed is:

1. A lamp bulb with optical pattern comprising a bulb body (1), a filament (2) and a conducting wire (3), wherein said filament (2) is conducted by the conducting wire (3) out from a rear portion of the bulb, characterized in that a head of said bulb body (1) has a convex arc outer shape such that eye-shaped halo patterns are generated and a solid triangle inner shape, and the filament (2) is connected to the conducting wire in a straight line.

2. The lamp bulb with optical pattern of claim 1, characterized in that the rear portion of the bulb body (1) is oblate.

3. The lamp bulb with optical pattern of claim 1, characterized in that the bulb body (1) is made of glass material.

4. A method of producing a lamp bulb with optical pattern according to claim 1, characterized in that when the head of the bulb body (1) is being rotated and sintered, hot air is blown, in fixed amounts, from the rear portion of the bulb body (1) into the head to make the head of the bulb body (1) present a convex arc outer shape and a solid triangle inner shape, and the filament (2) is connected rigidly to the conducting wire at a right angled, such that the filament (2) forms a straight line.

* * * * *